US006615884B2

(12) United States Patent
Havumaki et al.

(10) Patent No.: US 6,615,884 B2
(45) Date of Patent: Sep. 9, 2003

(54) DEBARKING SHAFT FOR A DEBARKING MACHINE

(75) Inventors: Jouni Havumaki, Vaaksy (FI); Pekka Kokko, Hollola (FI); Bruce Kirkpatrick, Lachine (CA)

(73) Assignee: Andritz Oy, Hollola (FI)

( * ) Notice: Subject to any disclaimer, the term of this patent is extended or adjusted under 35 U.S.C. 154(b) by 0 days.

(21) Appl. No.: 10/121,007

(22) Filed: Apr. 11, 2002

(65) Prior Publication Data

US 2002/0170625 A1 Nov. 21, 2002

Related U.S. Application Data

(60) Provisional application No. 60/283,770, filed on Apr. 13, 2001.

(51) Int. Cl.[7] ..... B27L 1/00

(52) U.S. Cl. ..... 144/208.9; 144/208.1; 144/208.4; 144/341

(58) Field of Search ..... 144/208.1, 208.4, 144/208.9, 341, 24.13, 208.7

(56) References Cited

U.S. PATENT DOCUMENTS

| | | | | |
|---|---|---|---|---|
| 3,228,440 A | | 1/1966 | Ferrabee | 144/208 |
| 5,094,281 A | | 3/1992 | Barnhill et al. | 144/208 J |
| 5,394,912 A | | 3/1995 | Hume | 144/208 R |
| 5,630,453 A | | 5/1997 | Ishizawa | 144/208.9 |
| 6,189,583 B1 | * | 2/2001 | Kokko et al. | 144/208.4 |

FOREIGN PATENT DOCUMENTS

| | | |
|---|---|---|
| DE | 24 38 043 A1 | 2/1976 |
| FI | 852752 | 1/1986 |

OTHER PUBLICATIONS

English Abstract of DE3524837, Feb. 1986.

Search Report from Finland.

International Search Report corresponding to International Application No. PCT/FI02/00121 dated Jun. 27, 2002.

* cited by examiner

*Primary Examiner*—W. Donald Bray
(74) *Attorney, Agent, or Firm*—Alix, Yale & Ristas, LLP

(57) ABSTRACT

The invention relates to a debarking shaft (3) for a debarking machine (1). The debarking shaft (3) has its teeth (4) designed as a number of annular tooth rims (20), each of said tooth rims comprising two or more releasably connected elements (21, 22), having the outer periphery provided with the teeth (4) and said elements being adapted to be fitted around a body member (25) of the debarking shaft (3) by way of press clamping.

21 Claims, 3 Drawing Sheets

DEBARKING SHAFT FOR A DEBARKING MACHINE

CROSS REFERENCE TO RELATED APPLICATIONS

This application claims the benefit of U.S. Provisional Application No. 60/283,770, filed Apr. 13, 2001.

BACKGROUND OF THE INVENTION

1. Field of the Invention

The invention relates to a debarking shaft for a debarking machine, and more particularly to an arrangement for fixing teeth to the debarking shaft for debarking logs.

2. Description of the Related Art

Debarking machines are used to strip the bark from logs prior to use of the logs for making paper or other wood products. Debarking machines typically employ a number of rotatable debarking shafts extending parallel to logs to be fed therethrough. The shafts are provided with a number of teeth extending beyond the circumferential surface of the shaft and adapted to strip bark off the logs transversely to the lengthwise direction of the logs and at the same to convey the logs transversely relative to said shafts. Damaged and/or worn teeth must be replaced to maintain the effectiveness of the debarking machine. Debarking machines are described in U.S. Pat. Nos. 4,685,498 and 5,394,912.

In these and other typical debarking machines, the teeth are generally mounted fixedly in certain positions. In one application, the individual teeth are replaceable, but even in that case the position of a tooth on the shaft remains always the same. Further, the individual replacement of worn teeth necessitates taking the debarking machine out of service for an extended time.

SUMMARY OF THE INVENTION

According to the invention, these and other deficiencies of the prior art are overcome by means of a debarking shaft in which the debarking shaft teeth are designed as a number of annular tooth rims, each of said tooth rims comprising two or more releasably connected elements. The outer periphery of the tooth rims are provided with the teeth and the inner periphery of said elements are configured to fit around a body of the debarking shaft by way of press clamping.

The tooth rim elements are preferably provided with clamping means for forcing the elements toward each other against the body member of a debarking shaft. The clamping means may comprise for example a headless screw, having one end provided with a left-handed thread and the other end with a right-handed thread, as well as a gripping section between the threads for turning the headless screw.

The debarking shaft is preferably in the form of a circular pipe. Thus, adjacent tooth rims present on a common shaft can be readily locked or clamped on the shaft at an angular position arbitrarily different from each other in the shaft rotating direction, the teeth of adjacent tooth rims being capable of providing the shaft e.g. with helixes. The relative axial distance in between tooth rims can also be adjusted as desired. The debarking shaft has its body member provided, preferably for each tooth rim, with a guide element, preferably a key and slot, for guiding the tooth rims into position.

The body member of the debarking shaft may also be configured in its cross-section as a polygon, whereby the tooth rims can be readily guided and clamped to various angular positions.

The teeth are preferably designed to be effective in both rotating directions of debarking shafts. The teeth effective in opposite rotating directions can be different from or similar to each other. When using different types of teeth in opposite rotating directions, the various rotating directions shall result in different barking capacities, e.g. for wintertime barking and summertime barking. It is also possible to use sharp teeth for the debarking of initially hard-to-bark or frozen logs, while worn teeth can be used for the treatment of easy-to-bark logs. The replacement is effected simply by dismounting a tooth rim and by remounting the same after turning it around.

Making one or more sections of a tooth rim toothless can also influence barking capacity. Hence, some of the tooth rims on a debarking shaft can be completely or partially toothless.

An object of the invention to provide a debarking shaft for a debarking machine, wherein the teeth of a toothed debarking shaft are readily removable and replaceable, as well as reversible regarding the rotating direction thereof.

Another object of the invention is to enable an axial and peripheral displacement and locking or clamping of teeth to a desired position.

BRIEF DESCRIPTION OF THE DRAWINGS

The invention will now be described in more detail with reference to the accompanying drawings, in which.

DETAILED DESCRIPTION OF THE PREFERRED EMBODIMENT

Figure 2:
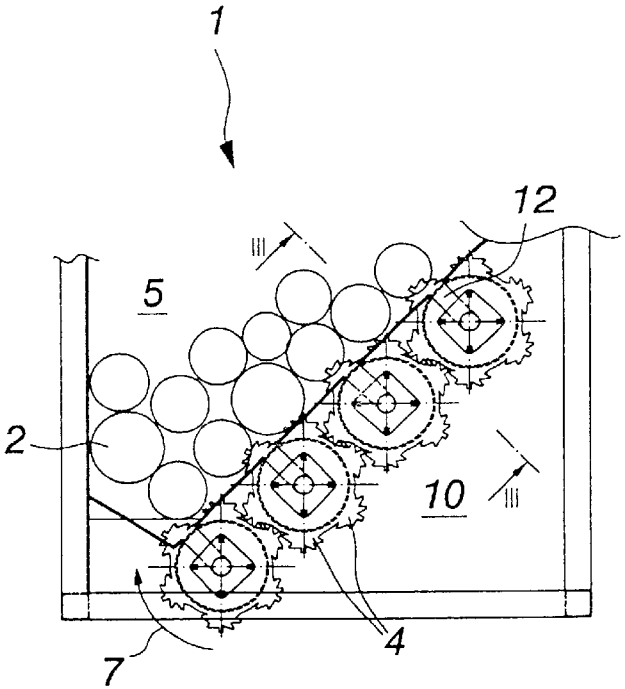
FIG. 2 is an end view of the debarking machine of FIG. 1, taken along line II—II thereof.
Figure 1:
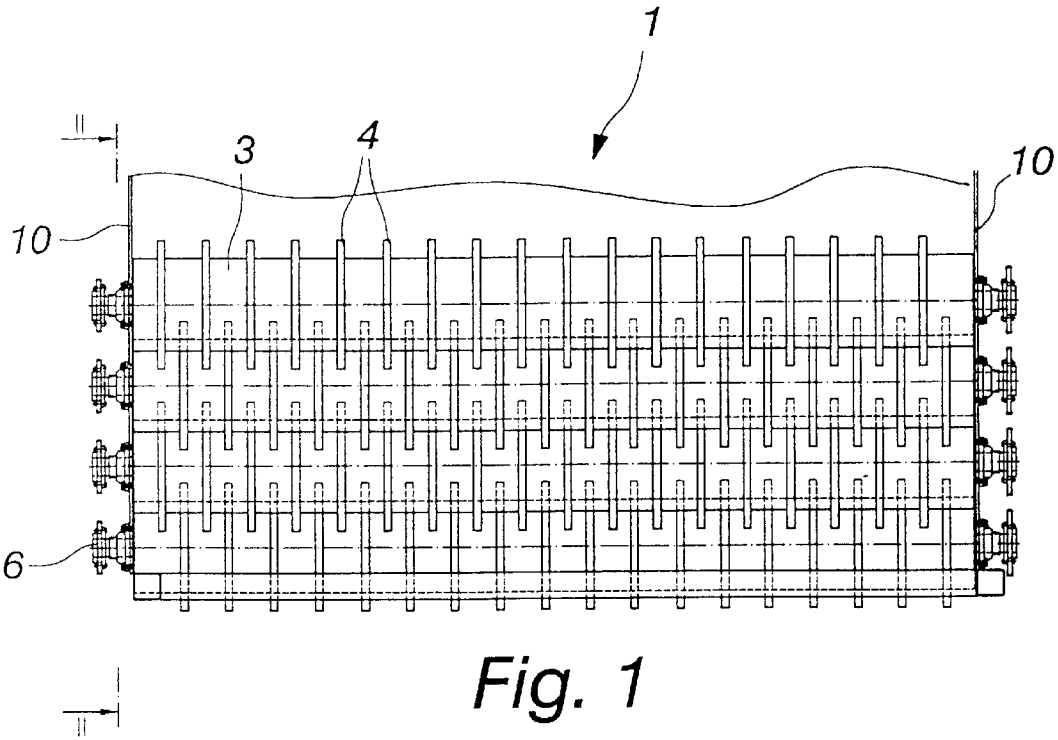
FIG. 1 is a schematic side view of a debarking shaft for a debarking machine in accordance with the present invention.
Figure 3:
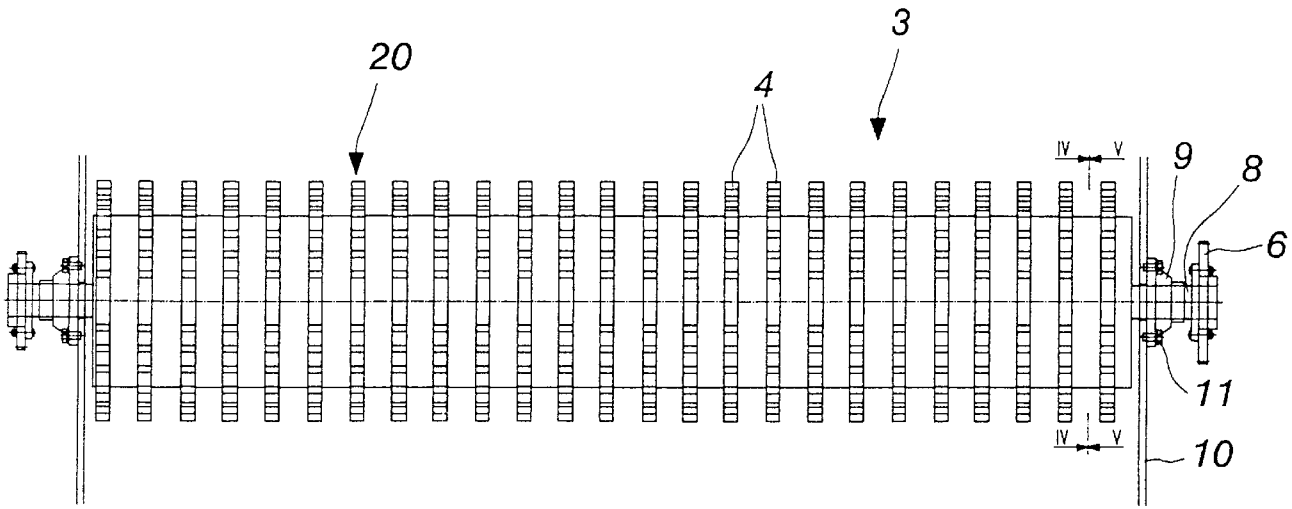
FIG. 3 is an enlarged view of a debarking shaft as shown in FIG. 2, taken along line III—III thereof.

A debarking machine 1 shown in FIGS. 1–9 is intended for the preliminary debarking of logs 2 prior to a separately performed final barking and for the expulsion of at least some of the removed barks from a wood flow passing through the debarking machine.

The debarking machine 1 is provided with a number of rotatable debarking shafts 3 extending parallel to the advancing direction of the logs 2 to be fed therethrough. In the illustrated example, the debarking shafts 3 have each end thereof provided with sprockets 6, whereby, at least at one end of the debarking machine 1, the sprockets 6 are by way of a sprocket chain (not shown) to each other and to the gear of an electric motor, not shown. The debarking shafts 3 are provided with a number of teeth 4 extending beyond the circumferential surface of the shaft 3 and adapted to strip bark off the presently processed logs 2 transversely to the longitudinal direction of the logs and at same time to convey the logs transversely relative to the debarking shafts 3.

The debarking shafts 3, together with the teeth 4 thereof, constitute a part of a support surface for carrying the logs 2 through the debarking machine 1. The illustrated example includes four debarking shafts 3 which are assembled relative to each other to define an inclined plane. Other than rotating shafts and their teeth, the debarking machine comprises solid surfaces which are designed for providing, together with the support surface constituted by the debarking shafts, an open-ended chute extending the length of the debarking machine 1.

Figure 4:
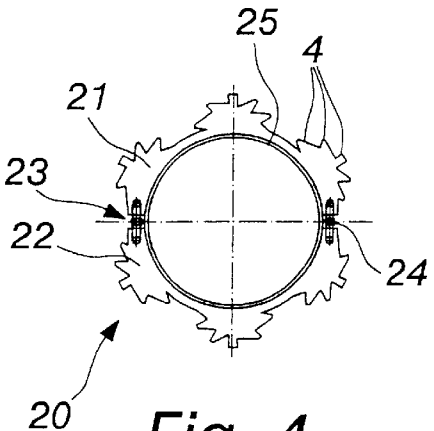
FIG. 4 is a sectional view through the shaft illustrated in FIG. 3, taken along line IV—IV thereof.
Figure 6:
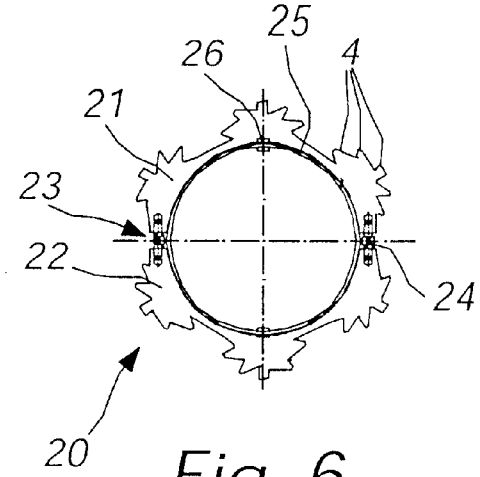
FIG. 6 is a sectional view through a circular debarking shaft in accordance with the present invention.

In accordance with one aspect of the present invention, each debarking shaft 3 has its teeth 4 configured as a number of annular tooth rims 20, as best shown in FIGS. 4–9. In the illustrated embodiments, each tooth rim 20 comprises two releasably connectable elements 21, 22, having the outer periphery thereof provided with the teeth 4. The elements 21, 22 are adapted to be clamped around a body member 25 of the debarking shaft 3. The elements 21, 22 of the tooth rim 20 are preferably provided with clamping means, generally designated by reference numeral 23, for forcing the elements 21, 22 toward each other against the body member 25 of the debarking shaft 3. In the example of FIG. 4, the clamping means 23 comprises a headless screw, having one end provided with a left-handed thread and the other end with a right-handed thread, as well as a gripping section 24 between the threads for turning the headless screw. The elements 21 and 22 are provided with mating threads, whereby the gripping section 24 can be turned for drawing the elements 21, 22 towards or away from each other. The body member 25 of the debarking shaft 3 is circular in its cross-section, being preferably constituted by a circular pipe. The body member 25 may be provided, for each tooth rim 20, with a guide element 26 (illustrated in FIG. 6), preferably a key and slot, for guiding the tooth rims 20 to positions predetermined therefor.

Figure 7:
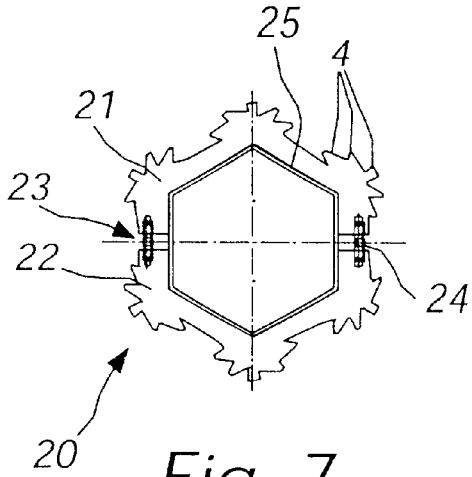
FIG. 7 is a sectional view through a polygonal debarking shaft in accordance with the present invention.

The debarking shaft 3 may also have its body member 25 designed in its cross-section as a polygon as shown in FIG. 7, whereby the tooth rims 21, 22 can be readily guided and clamped to various angular positions relative to the body member 25.

Figure 5:
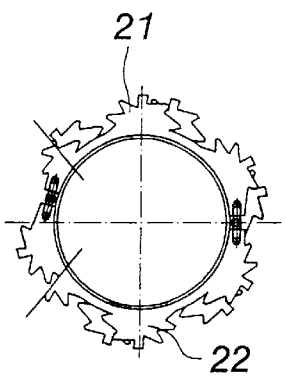
FIG. 5 is a sectional view through the shaft illustrated in FIG. 3, taken along line V—V thereof.
Figure 8:
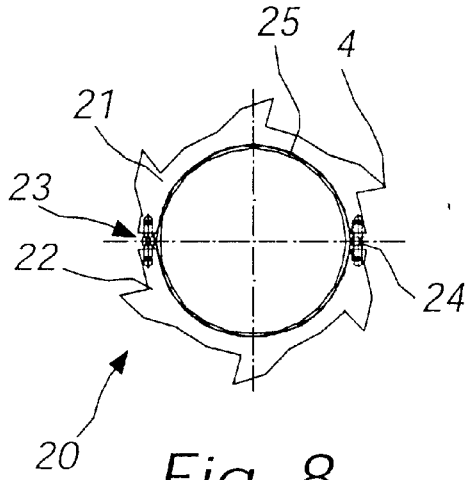
FIG. 8 is a sectional view through a circular debarking shaft equipped with teeth having a different configuration for each rotating direction of the shaft.
Figure 9:
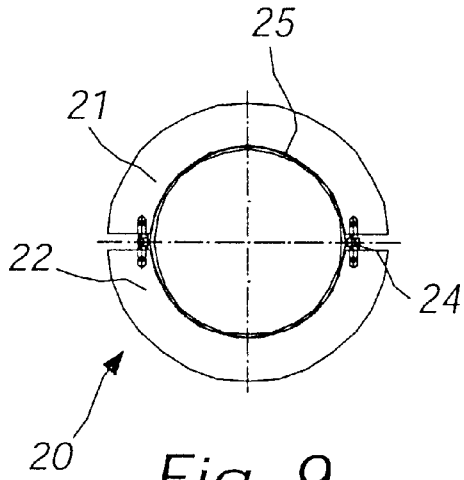
FIG. 9 is a sectional view through a circular debarking shaft equipped with rims that are toothless.

According to the example of FIG. 4, the teeth 4 may be designed to work in both rotating directions of the debarking shafts 3. The effective teeth 4 can be substantially identical in each other in different rotating directions, as shown in the example of FIG. 4, or different from each other, as shown in the example of FIG. 8. The choice of various tooth shapes can be used to have an impact on attainable barking capacity. Setting the teeth 4 of the adjacent tooth rims 20 at angular positions different from each other as shown in FIG. 5 can similarly influence barking capacity. One or more of the tooth rims 20 can also be toothless as illustrated in FIG. 9.

The debarking shafts 3 have each end thereof provided with smaller-diameter shaft stubs 8, on which are mounted bearings, along with bearing cups 9 therefor, as well as the sprockets 6. The bearing cups 9 are adapted to be secured with screws 11 to end panels 10 present at the ends of the debarking machine 1 in line with the debarking shafts 3. The end panels 10 have a top edge thereof provided with open-topped grooves 12 for the shaft stubs 8 of the debarking shafts 3, whereby, if necessary, the debarking shafts 3 can be readily lifted out by overhead route.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A debarking shaft for a debarking machine, said debarking machine comprising a number of rotatable debarking shafts extending parallel to an advancing direction of the logs and provided with a number of teeth extending beyond a circumferential surface of the shaft and adapted to strip bark off the logs transversely to a length of the logs and at the same to convey the logs transversely relative to said shafts, and said shafts, together with the teeth thereof, forming at least a part of a support surface, upon which the logs travel through the debarking machine, characterized in that said teeth are carried by a number of annular tooth rims, each of said tooth rims comprising two or more releasably connected elements having an outer periphery provided with the teeth and said elements being clamped around a body member of the debarking shaft.

2. A debarking shaft as set forth in claim 1, characterized in that the elements of the tooth rim are provided with clamps for forcing the elements toward each other against the body member of the debarking shaft.

3. A debarking shaft as set forth in claim 2, characterized in that the clamps comprises a headless screw, having one end provided with a left-handed thread and the other end with a right-handed thread, as well as a gripping section between the threads for turning the headless screw.

4. A debarking shaft as set forth in claim 1, characterized in that the debarking shaft body member comprises a circular pipe.

5. A debarking shaft as set forth in claim 1, characterized in that the debarking shaft body member is provided, for each tooth rim, with a guide element, preferably a key and slot, for guiding the tooth rims to position.

6. A debarking shaft as set forth in claim 1, characterized in that the debarking shaft body member has a polygonal cross-section.

7. A debarking shaft as set forth in claim 1, characterized in that the teeth strip bark from the logs in both rotating directions of the debarking shafts.

8. A debarking shaft as set forth in claim 1, characterized in that the teeth facing in opposite rotating directions of the debarking shaft are different from each other.

9. A debarking shaft as set forth in claim 1, characterized in that the teeth facing in opposite rotating directions of the debarking shaft are identical to each other.

10. A debarking shaft as set forth in claim 1, characterized in that the tooth rim has one or more sections which are toothless.

11. A debarking machine for removing bark from logs fed lengthways therethrough, said debarking machine comprising:

a plurality of rotatable debarking shafts, each debarking shaft comprising a shaft body;

a plurality of annular tooth rims, each of said tooth rims comprising two or more releasably connected elements having an outer periphery configured as debarking teeth; and clamping means for clamping said annular tooth rims to said shaft body.

12. The debarking machine of claim 11, wherein said clamping means comprises fastener means for drawing the elements toward each other around the shaft body.

13. The debarking machine of claim 12, wherein the fastener means comprises a headless screw having a left-hand threaded shank portion and a right-hand threaded shank portion connected by a gripping section between the left-hand and right-hand threaded shank portions for turning the headless screw.

14. The debarking machine of claim 11, wherein the shaft body is cylindrical.

15. The debarking machine of claim 11, wherein the shaft body is provided with a guide element for each tooth rim for guiding the tooth rims into position.

16. The debarking machine of claim 15, wherein the guide element comprises key projecting from the shaft body or a slot in the shaft body.

17. The debarking machine of claim 11, wherein the shaft body is configured in its cross section as a polygon.

18. The debarking machine of claim 11, wherein the tooth rims are provided with teeth that are effective at stripping bark from logs regardless of the direction of rotation of the debarking shafts.

19. The debarking machine of claim 18, wherein the teeth effective in one direction are different from the teeth effective in the other direction.

20. The debarking machine of claim 18, wherein the teeth effective in one direction are identical to the teeth effective in the other direction.

21. The debarking machine of claim 11, wherein one or more tooth rims have one or more elements which are toothless.

* * * * *